United States Patent [19]

Aelterman et al.

[11] Patent Number: 4,910,427

[45] Date of Patent: Mar. 20, 1990

[54] GLOW STARTER HOLDER WITH PROTECTION AGAINST R.F. OVERHEATING

[75] Inventors: Kris Aelterman, Hoboken, Belgium; Kathleen Bernard, Painted Post, N.Y.

[73] Assignee: North American Philips Corporation, New York, N.Y.

[21] Appl. No.: 290,931

[22] Filed: Dec. 28, 1988

[51] Int. Cl.[4] ..... H01J 61/54; H01J 61/34

[52] U.S. Cl. ..... 313/25; 313/560; 313/619; 313/239; 313/356

[58] Field of Search ..... 313/25, 560, 619, 239, 313/356

[56] References Cited

U.S. PATENT DOCUMENTS 3,780,327 12/1973 Vervaart et al. ..... 313/619 X

*Primary Examiner*—Kenneth Wieder

*Attorney, Agent, or Firm*—Brian J. Wieghaus

[57] ABSTRACT

A discontinuous annular metallic holder for a glow starter in a high pressure discharge lamp. The holder has a hexagonal shape and encircles the bulb of the glow starter. One side is welded to one of the current-supply conductors extending from the lamp stem and two of the sides are parallel to the plane of the getters. The lower parallel side closest to the getter plane has an opening extending the length of the side to define an electrical discontinuity and to prevent a continuous circuit path within the lower side. The gap reduces the current induced in the lower side and resultant heating when the holder is subjected to an electromagnetic field during flashing of the getters. The reduced temperature of the lower side prevents damage to the glow starter.

9 Claims, 4 Drawing Sheets

GLOW STARTER HOLDER WITH PROTECTION AGAINST R.F. OVERHEATING

BACKGROUND OF THE INVENTION

The invention relates to a holder for a glow starter switch in electric discharge lamps. More specifically, the invention relates to a metallic annular holder for the glow starter which prevents overheating of the glow starter when the holder is subjected to an electromagnetic field.

Electric discharge lamps are often provided with a glow starter switch, which when connected to a ballast, provides a high voltage pulse across the electrodes which aid in starting the discharge device. The glow starter is normally supported within the outer envelope of a discharge lamp by a metallic holder which encircles the bulb of the glow starter and which is welded to one of the frame members or current-supply conductors supporting the discharge device. One type of glow starter comprises a glass bulb filled with a predetermined gas, a pair of fixed contact electrodes, and a bimetallic contact. During starting, the voltage applied at the glow starter produces a glow discharge between the contacts. The glow discharge heats the bimetallic strip which flexes and bridges the contact electrodes. This short-circuits the current-supply through the ballast and also extinguishes the glow discharge in the glow starter switch. The bimetallic contact then cools and breaks contact with the contact electrodes which interrupts the short circuit current through the ballast and causes a high-voltage spike across the electrodes.

Electric discharge lamps are provided with getters for removing trace amounts of undesired gases remaining within the outer lamp envelope after it has been sealed and evacuated to a predetermined pressure. The getter often is disposed on a disc-shaped support which is secured to one of the current-supply conductors extending from the lamp stem by a wire leg extending from the getter support. The disc-shaped getter support is positioned at a predetermined orientation with respect to the lamp axis and defines a getter plane. When two getters are included in the lamp, the disc-shaped supports for each are often positioned in a common getter plane. The term "getter" will hereinafter refer to the disc-shaped getter support with the getter material disposed thereon.

To eliminate the trace impurities remaining within the evacuated outer envelope, the getter material is activated by heating the getter in a radio frequency (R.F.) electromagnetic field for several seconds, which is known as "flashing" of the getter. The sealed outer envelope is positioned near an electromagnetic source such that the field lines of the electromagnetic field are transverse to the disc-shaped getter supports to achieve maximum coupling between the getter support and the applied field, and therefore maximum heating of the getter material.

A common arrangement is to secure the getter supports in the lamp transverse t the lamp axis. The sealed lamp is then positioned within a circular coil which is energizable for producing an R.F. electromagnetic field. The lamp is positioned with the getter supports parallel to and in the same plane as that of the coil. In this position, the getters are in the region of the greatest field strength and are also transverse to the magnetic field.

However, the electromagnetic field also interacts with the metallic glow starter holder and induces an alternating current in the holder. The induced current greatly increases the temperature of the holder, often to a point such that portions of the holder glow. These portions are the parts of the holder transverse to the electromagnetic field and closest to the getters.

Heating of the glow starter holder is undesirable because the hottest parts of the holder can damage the glow starter by cracking the glow starter bulb. Alternatively, the heat from the holder can set free impurities in the glass of the glow starter bulb, which then contaminate the gas inside the glow starter bulb and deteriorate the performance of the glow starter.

The getter and the glow starter are normally positioned within the outer lamp envelope near the lamp base so that light from the discharge device is not obstructed. Another reason for the position of the getters near the lamp base is to ensure that the getter film resulting from the flashing of the getters is deposited on the inner surface of the lamp envelope near the lamp base so that the film does not obscure light from the discharge device. The proximity of the getter and glow starter is thus determined by the size of the outer envelope in the region of the lamp cap. Accordingly, it is usually not a viable alternative to space the glow starter and metallic holder a sufficient distance from the getters such that it is not overheated by the electromagnetic field during flashing of the getters.

SUMMARY OF THE INVENTION

It is an object of the invention to provide a lamp having a metallic glow starter holder which exhibits greatly reduced heating when subjected to an electromagnetic field during flashing of the lamp getters.

It is another object of the invention to provide a glow starter holder having the above characteristics which is easy to manufacture and which can be simply fixed to one of the frame members or current-supply conductors of a high pressure discharge lamp.

The invention is based on the recognition of the fact that when the lamps are arranged in the getter flashing unit to flash the getters by exposing them to an R.F. electromagnetic field, the getters are normally positioned in the region of the maximum field strength and the field strength decreases with increasing distance from the getter. Thus, those portions of the glow starter holder positioned closest to the getters are subjected to a more intense electromagnetic field than portions positioned further away.

The invention is based on the further recognition that those portions of the metallic holder which exhibit the greatest heating are the portions nearest the getters and parallel to the disc-shaped getter supports. It is believed that these portions of the holder exhibit the greatest heating because they are most nearly transverse to the field lines and have the greatest coupling with the R.F. electromagnetic field.

The objects of the invention are achieved by providing a glow starter holder which is a discontinuous annular metallic clip encircling the glow starter bulb. It is welded to one of the current-supply conductors extending from the lamp stem. The portion of the holder closest to the plane of the getters, which is the portion subject to the highest field strength and the greatest coupling with the electromagnetic field, has a gap for preventing a continuous current path in said portion. The gap not only interrupts the current path within the portion but also reduces the area coupled with the electromagnetic field.

In a preferred embodiment, the holder is hexagonal and is arranged with two sides parallel to the plane defined by the getters. The parallel side closest to the getters is the portion having the gap. A clip of this type is commercially available. It is often used for securing the discharge vessel support frame to the outer envelope by encircling a glass protrusion at the top interior surface of the outer lamp envelope.

DESCRIPTION OF THE PREFERRED EMBODIMENTS

Figure 1:
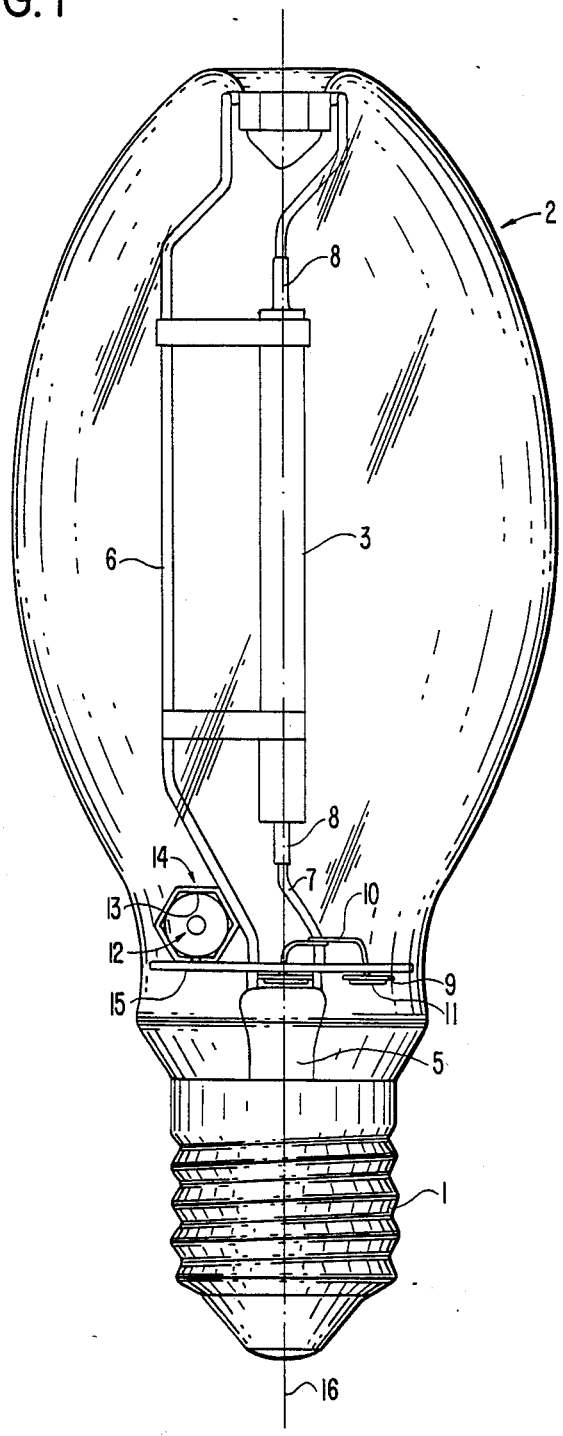
FIG. 1 is a side view of a high pressure discharge lamp having a glow starter holder according to the preferred embodiment of the invention.

FIG. 1 shows a high pressure discharge lamp according to the invention having a lamp base 1 connected to an outer envelope 2 in which a discharge device 3 is disposed. The space within the outer envelope is evacuated to a predetermined pressure. Current-supply conductors 6, 7 extend from the lamp stem 5 and are connected to respective contact portions of the lamp base 1. Each current-supply conductor is connected to a respective lead-through 8 extending from the discharge device for energizing the discharge device and for supporting the discharge device. Getters 9 for eliminating gaseous impurities remaining within the evacuated outer envelope 2 are deposited on disc-shaped getter supports 11 and are supported near the lamp stem 5 via a wire leg 10 welded to the current-supply conductor 7. The disc-shaped getter supports 11 are positioned in a common plane which defines a getter plane that is transverse to the lamp axis 16.

A glow starter switch 12 for starting the discharge device 3 is electrically connected in series with the discharge electrodes of the discharge device. The glow starter has a sealed glass bulb 13 filled with a predetermined gas and is supported by an annular metallic holder 14 having a hexagonal shape. The holder has an extent along the length dimension of the glow starter bulb which extent defines the holder axis. The electrical connection of the glow starter switch and the remainder of the preheat circuit are not shown for the sake of clarity. One type of glow-starter switch is described in *IES Lighting Handbook*, Reference Volume, Waverly Press, Inc., Baltimore, Md., 1981, which is hereby incorporated by reference. One side of the hexagonal holder is welded to the current-supply conductor 6 with two of the sides parallel to the disc-shaped portion of the getters. A mica heat shield 15 is present between the glow starter and the lamp stem 5 to prevent excessive heating of the glow starter during sealing of the lamp stem 5 in the outer envelope 2.

Figure 2:
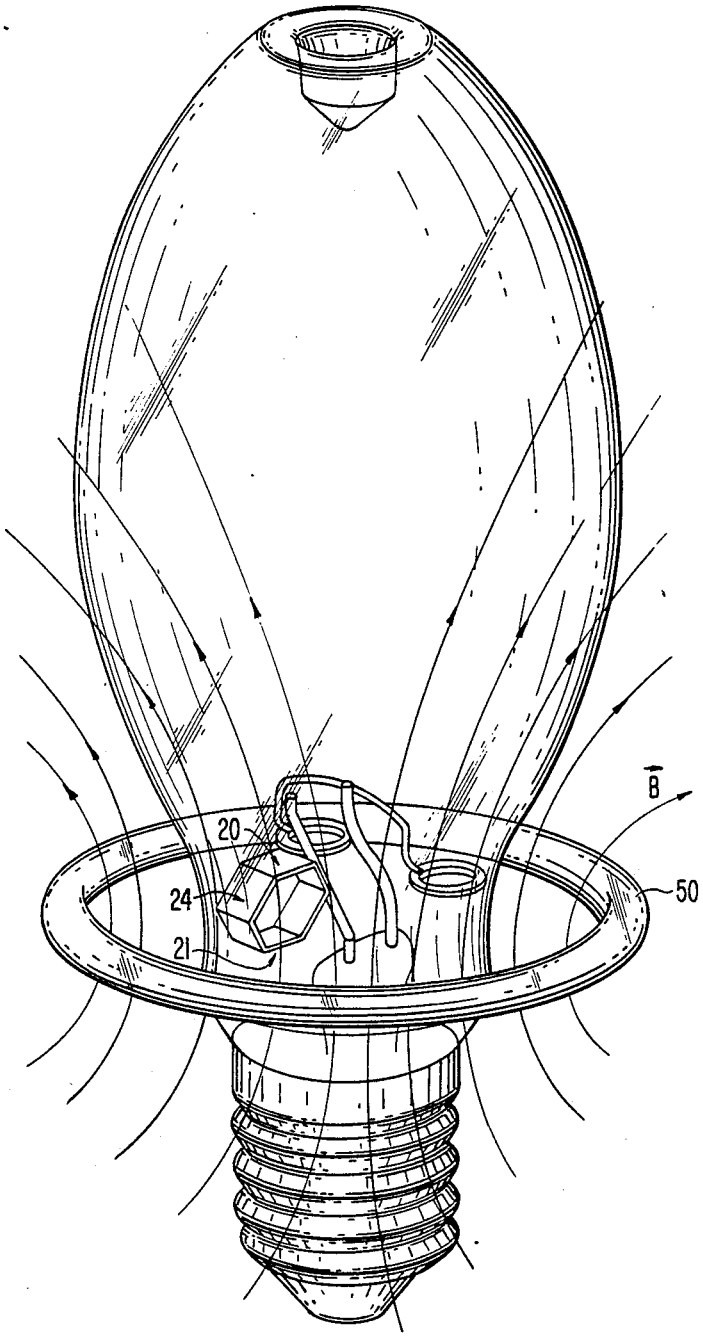
FIG. 2 is an isometric view of a high pressure discharge lamp positioned within the circular coil of a common getter flashing unit. For illustrative purposes, the octagonal glow starter holder is shown having a continuous lower side.

For the purpose of explaining the problem of overheating of the lower side of a glow starter holder, FIG. 2 shows a discharge lamp similar to the lamp of FIG. 1 but having a holder 24 which is a continuous metallic clip without a discontinuity on its lower side. The metallic holder 24 is welded to the current-supply conductor 6 with sides 20, 21 parallel to the plane defined by the disc-shaped portion of the getters. The discharge device and glow starter have been omitted from FIG. 2 for the sake of clarity.

FIG. 2 illustrates the position of the lamp in a common apparatus for flashing the getters. The apparatus has a coil 50 which is energizable for producing a radio frequency electromagnetic field of sufficient field strength to heat the getters 10 and to activate the getter material disposed thereon within a reasonable amount of time, i.e. five-ten seconds. To flash the getters, the sealed lamp is positioned with the getters in the same plane as that of the circular coil so that the getters are subjected to the maximum electromagnetic field strength. Representative field lines are shown intersecting the getters 9. The getters are transverse to the field lines for maximum coupling.

However, with the lamp in this position, the holder 24 is also within the magnetic field. Side 21 is the portion of the holder subject to the most intense heating because it is closest to the plane of the getters, and therefore subject to the maximum field strength, and also exhibits the greatest coupling with the magnetic field because it is transverse to the field lines. This is evidenced by glowing of the lower side only during getter flashing.

Figure 3:
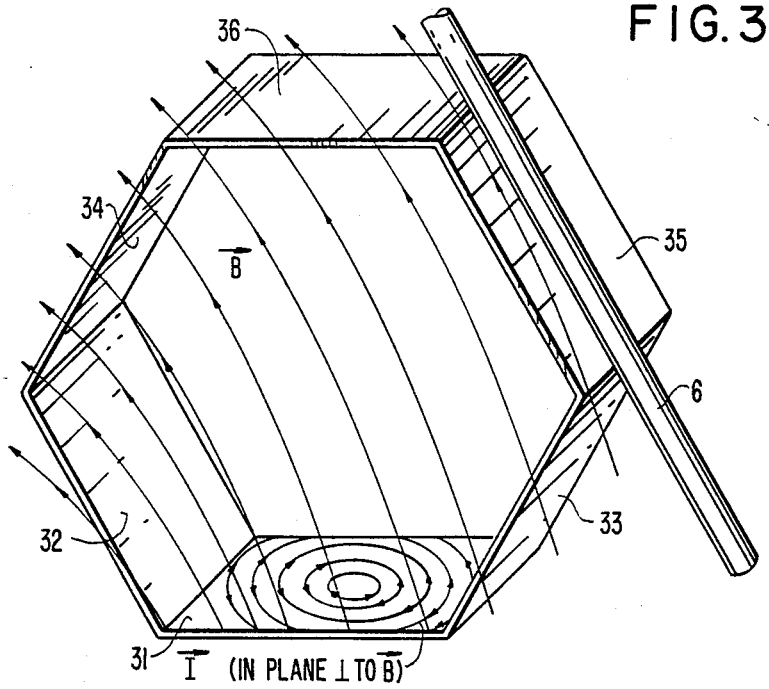
FIG. 3 is an isometric view of a glow starter holder not having a gap on its lower side to illustrate the coupling with a magnetic field of a typical flashing unit.

FIG. 3 illustrates the coupling of the metallic holder 24 with the electromagnetic field. Representative field lines are shown intersecting the sides of the holder as if the holder occupies the same position with respect to the getters and coil as shown in FIG. 2. Side 35 is welded to the current-supply conductor 6. Side 31 is a continuous planar portion and is the side closest to and parallel to the plane of the getters. The current induced in this portion is an alternating current and is represented by the symbol "I". Since the side 31 is continuous, a continuous current path is present which facilitates heating of that side when it is subject to the electromagnetic field during the process of getter flashing. Sides 32 and 35 are subject to less heating because they are closest to being parallel to the field lines, and therefore have the least coupling with th magnetic field. It is believed that sides 33, 34, and 36 are also subject to less heating than side 31 because they are spaced further from the getter plane and are less transverse to the field lines than side 31.

Figure 4:
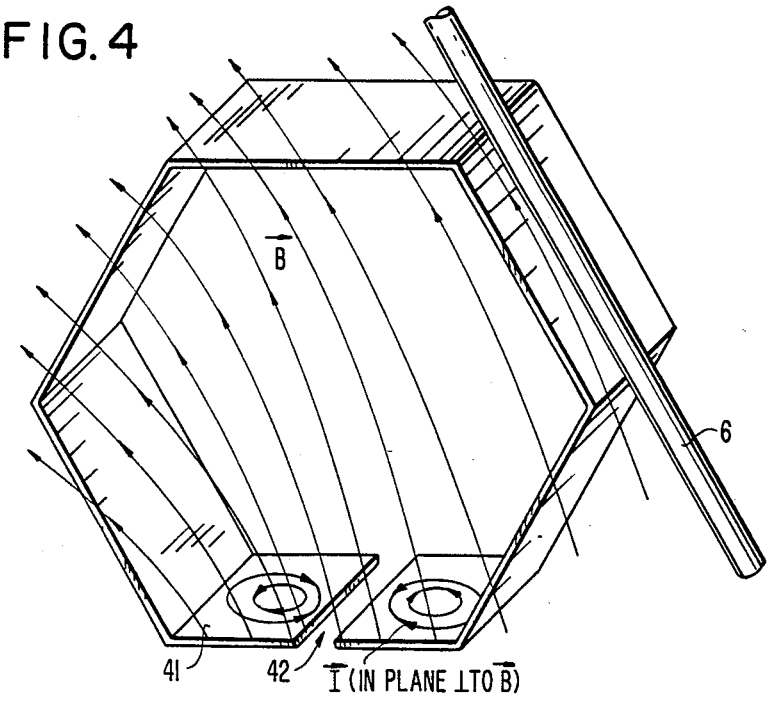
FIG. 4 is an isometric view of a glow starter holder according to the preferred embodiment of the invention having a gap on its lower side.

FIG. 4 shows a glow starter holder according to the preferred embodiment of the invention. Side 41 corresponds to the position of side 31 in FIG. 3. Since side 41 is the side subject to the most intense heating, this side is provided with a gap or opening 42 spanning the entire side. The gap provides an electrical discontinuity which eliminates the continuous circuit path present in side 31 as shown in FIG. 3. The gap also reduces the area of the side coupled by the magnetic field which also contributes to the reduced heating of side 41. The single continuous current path shown in FIG. 3 is replaced by two smaller current paths as shown in FIG. 4.

In order to establish the reduced heating of the glow starter holder according to the invention, a comparison test was conducted. Two incomplete lamps were made, each having an outer envelope with a stem press, getters, mica disc, and a glow starter holder as shown in FIG. 1. The partial lamp did not have a lamp cap, glow starter, or discharge device.

In the first partial lamp, the glow starter holder according to the preferred embodiment was mounted with the opening 42 facing down as shown in FIG. 4. In the second partial lamp, the holder according to the preferred embodiment was used but was mounted in a rotated orientation with the opening 42 in the position occupied by side 34 as shown in FIG. 3. Thus, in he second lamp, the lower side of the holder was a continuous side like side 31 of FIG. 3. A thermo-couple was attached to the bottom side (41, 31) of each clip and the leads brought outside of the lamp via a sealed tubulation.

The lamps were then sealed and evacuated. The lamps were placed in a conventional flashing unit having an energizable coil as shown in FIG. 2 to flash the getters. The getters were subject to the electromagnetic field for a period of nine (9) seconds. Due to electromagnetic interference, the temperature of the holder sides could not be read during operation of the flashing unit. After the nine (9) second period, the flashing unit was stopped and the temperature of the lower side was read three (3) seconds after turning off the flashing unit. The holder according to the invention had a temperature of 329° C. on its lower side with the opening. The holder on the second lamp had a temperature of 511° C. on its continuous lower side. This data is summarized in Table 1.

TABLE 1

| | |
|---|---|
| Discontinuous holder | 329° C. |
| Starter rating | 400° C. |
| Continuous holder | 511° C. |

The above temperature differences are significant because the glass bulbs of commercially available glow starters are normally rated to only 400° C. Since the holder according to the prior art had a temperature of over 500° on its lower side after flashing, that holder will crack the bulb of the glow starter in a significant percentage of lamps rendering both the glow starter and the discharge lamp inoperative. By contrast, the clip according to the invention remained at a temperature under the rate temperature of the glow starter bulb and therefore would not crack the glow starter bulbs.

Additionally, even if the higher temperature of the prior art clip did not crack the bulb, the higher temperature would tend to drive impurities out of the glass bulb and into the gas fill of the glow starter. This adversely affects the operability of the glow starter by reducing the voltage at which the bimetallic element opens and closes the contact electrodes.

Figure 5:
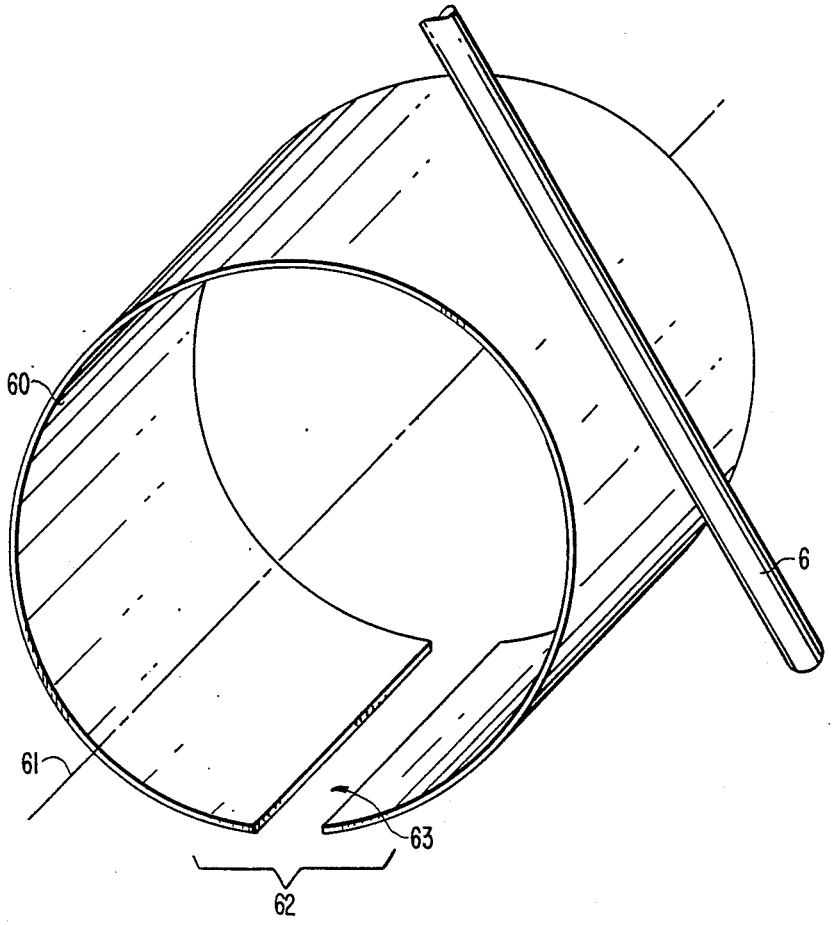
FIG. 5 is an isometric view of a glow starter holder according to another embodiment of the invention.

FIG. 5 show a glow starter holder 60 according to another embodiment of the invention. The older is a discontinuous annular metallic clip having a circular tubular shape with an extent along the wall of the glow starter. It is welded to the current-supply conductor 6 of the lamp shown in FIG. 1 with its axis 61 parallel to the plane of the getters. The clip has a lower portion 62 which extends parallel to the disc-shaped portion of the getters an which is the portion subject to the strongest magnetic field during flashing of the getters. This portion has a gap or opening 63 for preventing a continuous circuit path in the lower portion 62 which reduces the induced current and heating of the lower portion when it is subject to an electromagnetic field during flashing of the getters.

What is claimed is:

1. In a high pressure discharge lamp having an outer lamp envelope sealed in a gas tight manner, a discharge device within said outer envelope and energizable for emitting light, a getter, and a glow starter for starting said discharge device disposed within said outer envelope, said glow starter having a starter envelope, the improvement comprising:

means for supporting said getter within said outer envelope t a predetermined orientation which defines a getter plane; and a discontinuous annular metallic holder for holding said glow starter, said holder having a plane parallel to said getter plane and having a gap for preventing overheating o said holder plane by electromagnetic coupling.

2. In a high pressure discharge lamp having an outer lamp envelope sealed in a gas tight manner, a discharge device within said outer envelope and energizable for emitting light, a getter having a planar portion and a glow starter for starting said discharge device disposed within said out®r envelope, said glow starter having a starter envelope, the improvement comprising:

means for supporting said planar portion of said getter within said outer envelope at a predetermined orientation which defines a getter plane; and a discontinuous annular metallic holder for holding said glow starter, said holder having a plane parallel to said planar getter portion having a gap for interrupting a continuous current path in said plane.

3. A lamp as claimed in claim 2, wherein said holder is hexagonal and is arranged with the side closest to said getter plane parallel to said getter plane, said closest side being said plane having said opening.

4. A lamp as claimed in claim 3, wherein said lamp further comprises current-supply conductors for energizing said discharge device and for supporting said discharge device within said outer envelope, and said fixing means comprises said holder being welded to one of said current-supply conductors.

5. A lamp as claimed in claim 4, wherein said means for supporting said getter comprises a length of wire extending from said getter having an end welded to the other of said current-supply conductors.

6. A lamp as 2, wherein said lamp further comprises current-supply conductors for energizing said discharge device and for supporting said discharge device within said outer envelope, and said fixing means comprises said holder being welded to one of said current-supply conductors.

7. An electric lamp, comprising:

(a) an outer envelope defining a lamp axis sealed in a gas tight manner and having a sealed end;

(b) an elongate discharge device within said envelope aligned with said lamp axis having a first end near said outer envelope sealed end and a second end remote from said outer envelope sealed end;

(c) a pair of current-supply conductors extending through said sealed end for energizing said discharge device and supporting said discharge device in said outer envelope, a first of said current-supply conductors extending along the length dimension of said discharge device spaced from said lamp axis and connected to said second end of said discharge device, the second of said current-supply conductors being connected to said first end of said discharge device;

(d) a getter comprising a planar portion, and a length of wire connected to said planar portion and to said second current-supply conductor for supporting said planar portion in a predetermined getter plane;

(e) a glow starter for starting said discharge device, said glow starter comprising a starter envelope; and (f) a holder for holding said glow starter comprising a annular metallic wall circumferentially surrounding said starter envelope and having a length dimension along said starter envelope which defines a holder axis, said holder being secured to said first current-supply conductor with said holder axis parallel to said getter plane, the portion of said holder wall closest to said getter plane having an opening spanning said length dimension for preventing a continuous current path in said portion.

8. A lamp as claimed in claim 7, wherein said holder wall is polygonal and is arranged with the side closest to said getter plane parallel to said getter plane, said closest side being said portion having said opening.

9. A lamp as claimed in claim 8, wherein said holder wall is hexagonal.

* * * * *